US010712109B1

(12) United States Patent
Birgen et al.

(10) Patent No.: US 10,712,109 B1
(45) Date of Patent: Jul. 14, 2020

(54) HAPTIC FIREARM MAGAZINE

(71) Applicant: Midwater Collective, LLC, Phoenix, AZ (US)

(72) Inventors: William Birgen, Tempe, AZ (US); Ira Hayes, San Diego, CA (US); Kerr Gelvin, Paradise Valley, AZ (US)

( * ) Notice: Subject to any disclaimer, the term of this patent is extended or adjusted under 35 U.S.C. 154(b) by 0 days.

(21) Appl. No.: 16/179,058

(22) Filed: Nov. 2, 2018

Related U.S. Application Data

(60) Provisional application No. 62/581,537, filed on Nov. 3, 2017, provisional application No. 62/674,169, filed on May 21, 2018.

(51) Int. Cl.
*F41A 9/65* (2006.01)
*F41A 17/34* (2006.01)
*F41A 9/62* (2006.01)

(52) U.S. Cl.
CPC ..... *F41A 9/65* (2013.01); *F41A 9/62* (2013.01); *F41A 17/34* (2013.01)

(58) Field of Classification Search
CPC .... F41A 9/65; F41A 9/62; F41A 17/34; F41A 9/61; F41A 9/63
USPC ..... 42/50
See application file for complete search history.

(56) References Cited

U.S. PATENT DOCUMENTS 4,142,313 A 3/1979 Musgrave
4,216,601 A 8/1980 Musgrave
4,219,953 A 9/1980 Musgrave
5,642,581 A * 7/1997 Herold ..... F41A 9/62 42/1.02
5,735,070 A 4/1998 Vazquez
5,799,432 A 9/1998 Wright, Sr.
5,826,360 A 10/1998 Herold
6,094,850 A * 8/2000 Villani ..... F41A 9/62 42/1.02
7,055,276 B2 6/2006 McPherson
7,234,260 B2 6/2007 Delgado
7,567,232 B2 7/2009 Rosenberg
7,730,654 B2 6/2010 Kim
8,191,297 B2 6/2012 Gwillim, Jr.
8,387,295 B2 3/2013 Glock
8,739,033 B2 5/2014 Rosenberg
9,303,937 B2 4/2016 Acarreta
9,360,937 B2 6/2016 Rosenberg
9,784,511 B2 10/2017 Faughn
2008/0276517 A1* 11/2008 Delgado Acarreta ..... F41A 9/62 42/1.02
2010/0299985 A1 12/2010 Delgado
2012/0167423 A1 7/2012 Kindt et al.
2014/0352189 A1* 12/2014 Fitzpatrick ..... F41A 9/83 42/50
2015/0267981 A1 9/2015 Faughn
2015/0345882 A1* 12/2015 Nakayama ..... F41A 9/70 42/50
2016/0252317 A1* 9/2016 Biran ..... F41A 9/65 42/1.01
2016/0298918 A1* 10/2016 Baker ..... F41A 9/65
2018/0299217 A1* 10/2018 Hedeen ..... F41A 9/62
2019/0162495 A1* 5/2019 Muller ..... F41A 9/66

* cited by examiner

*Primary Examiner* — Joshua E Freeman
(74) *Attorney, Agent, or Firm* — Venjuris, P.C.

(57) ABSTRACT

A haptic firearm magazine that exploits at least one natural vibration mode of its structure.

17 Claims, 5 Drawing Sheets

HAPTIC FIREARM MAGAZINE

FIELD OF THE INVENTION

The present invention relates to magazines for firearms.

SUMMARY OF THE INVENTION

The haptic firearm magazine is constructed to exploit at least one predicted natural vibration mode of a structure. Aspects of the invention may be incorporated in a magazine body having a first portion and a second portion wherein if a haptic force is applied to the magazine body, the first portion flexes more than the second portion and according to a natural vibration mode of the magazine body. The first portion and second portions may correspond to the antinodes and nodes respectively of a standing wave pattern of a natural vibration mode of the magazine body, and of which there may be a plurality of resonant vibration modes from which the standing wave pattern is selected.

Aspects may be implemented in a first portion and second portion comprised of alternate materials having different flexibilities, or of the same material constructed to have alternate flexibilities. Accordingly, the first portion may be thinner than the second portion, or the second portion may be constructed by placement of structural stiffening ribs on the first portion and according to the standing wave pattern.

The magazine body may be constructed to have a base housing a haptic motor and the base may be coupled to the first or second portions to excite the magazine body at the resonant vibration mode.

Numerous advantages and features of the present invention will become readily apparent from the following detailed description of the invention and the embodiments thereof, from the claims and from the accompanying drawings.

Figure 1:
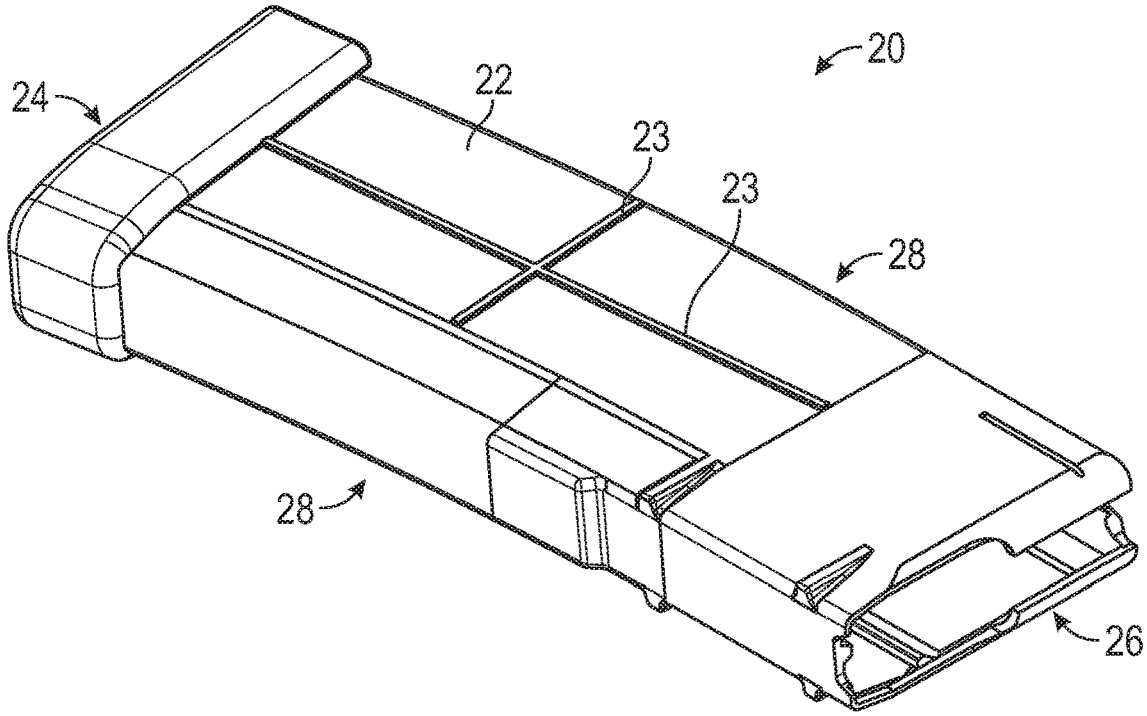
FIGS. 1-4 illustrate embodiments incorporating aspects of the invention.

The objects, features and advantages of the present invention will be more readily appreciated upon reference to the following disclosure when considered in conjunction with the accompanying drawings, wherein reference numerals are used to identify the components in the various views.

DESCRIPTION OF PREFERRED EMBODIMENTS

The figures illustrate an embodiment of a firearm magazine incorporating aspects of the invention. The aspects of the invention disclosed may be may scaled or modified for any and all calibers and weapon types. It is contemplated that one application of the disclosed embodiment is to create a smart magazine that is capable of conveying to the user or the user's colleagues at least one category of information pertaining to the state of the magazine or firearm. In one such application, the preferred embodiment may alert the user that the quantity of ammunition has reached a threshold level. Or, in another example, to alert the user that the firearm safety catch has been toggled to an "off" or "on" condition. Accordingly, the features of the disclosed embodiment should not be construed as limiting any aspect of the invention.

The firearm magazine embodiment described herein is preferably selected, designed, retrofitted, configured, or assembled to augment a response or output due to a haptic force applied to the magazine. In each embodiment, a physical system is designed to operate with an applied force and exhibit at least one resonant vibration mode. At least one component of the physical system comprised of the magazine and the applied haptic force, may be selected, designed, or tuned to have a natural frequency substantially excited by the applied haptic force, or the applied haptic force may be chosen to match the inherent natural frequency of the magazine construction. As a result, when excited by the applied force, the magazine exhibits an augmented haptic response, which response is greater than if excited at other than a natural resonant vibration mode. The benefits of an augmented haptic response include power efficiency and/or increased likelihood of feeling a haptic vibration notification.

In general, the magazine embodiments disclosed herein comprise a magazine body 20 selected or configured to have at least one natural vibration mode that excited by a corresponding haptic force frequency selected to excite the magazine body 20 at the at least one natural vibration mode. In paring the magazine body 20 and haptic periodic force, the magazine body 20 structures may be selected, designed, modified, or adapted to have at least one natural vibration mode that corresponds to the frequency of the applied haptic force. For example, the magazine body 20 may generally comprise a first portion and a second portion wherein the first portion flexes more than the second portion and wherein an applied haptic force comprises a first force configured to transfer force to the body 20 and vibrate the first portion more than and relative to the second portion, and at a first frequency that corresponds with a natural vibration mode of the magazine body 20. Further, the structure may be configured to exploit at least another vibration mode such that the body 20 may comprise an alternate first portion and an alternate second portion wherein the alternate first portion flexes more than the alternate second portion, and wherein a haptic force having an alternate frequency is also configured to transfer the alternate frequency periodic force to the body 20 and vibrate the alternate first portion more than and relative to the alternate second portion at the alternate frequency that corresponds with an alternate natural vibration mode of the magazine body 20.

Figure 2:
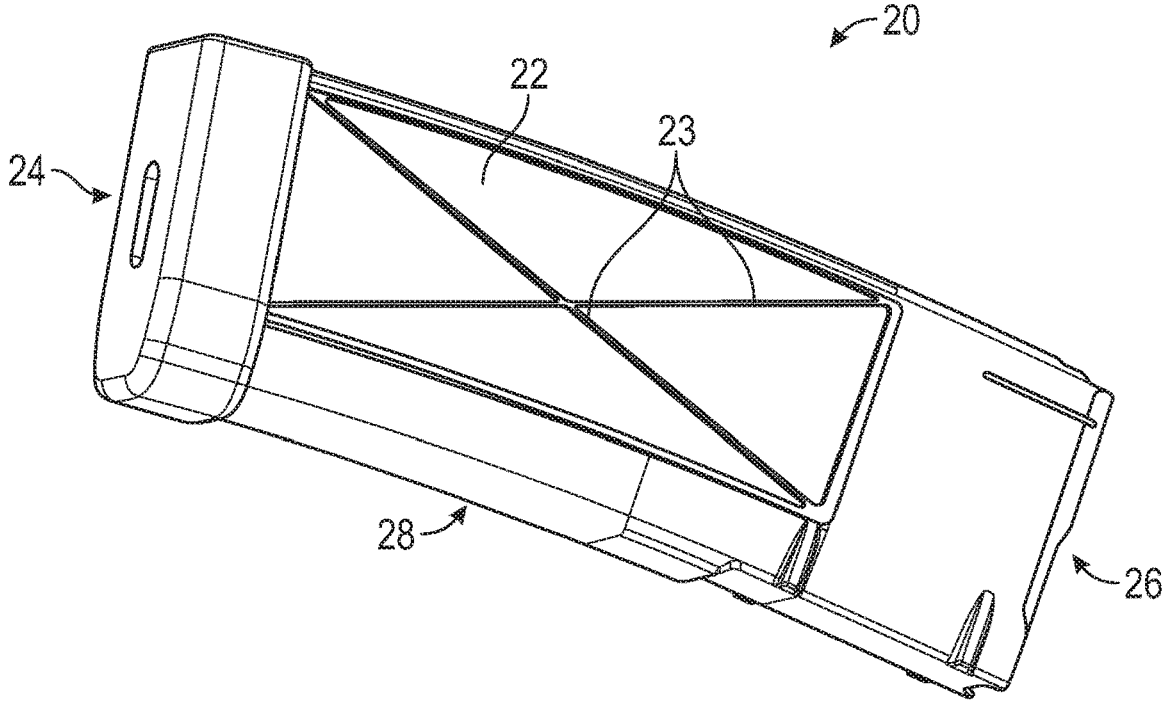
Figure 3:
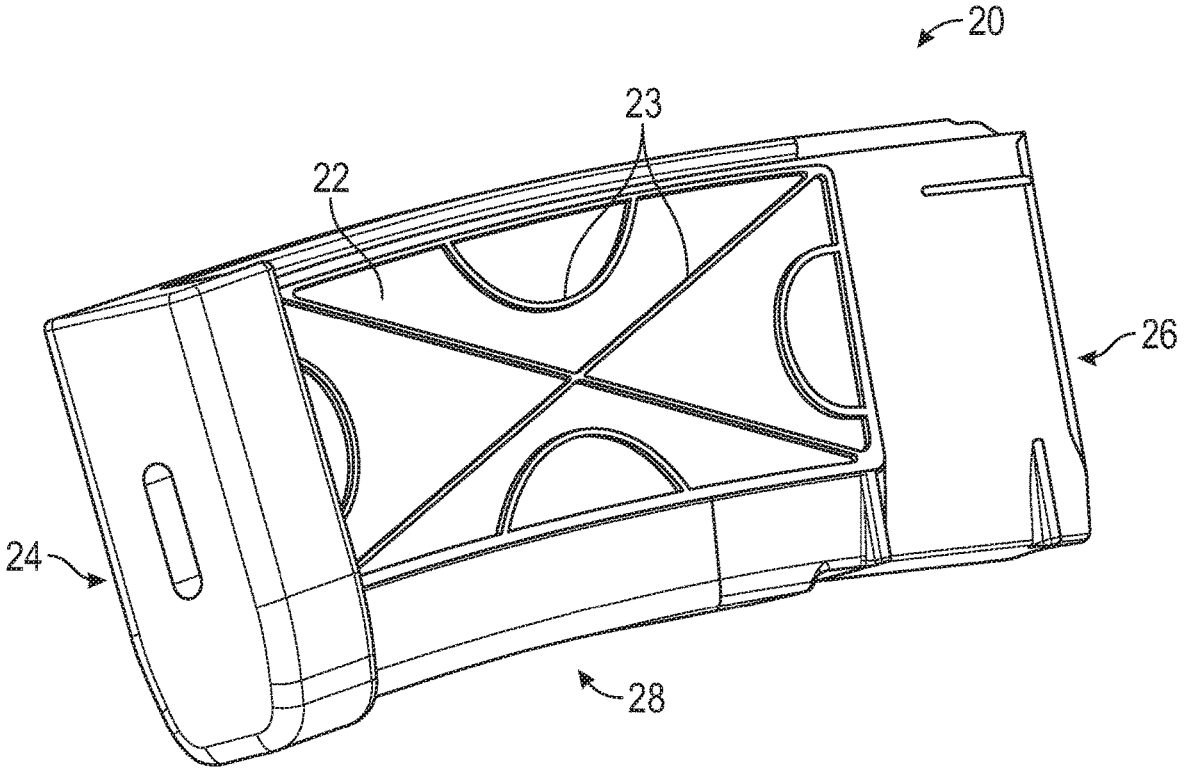
Figure 4:
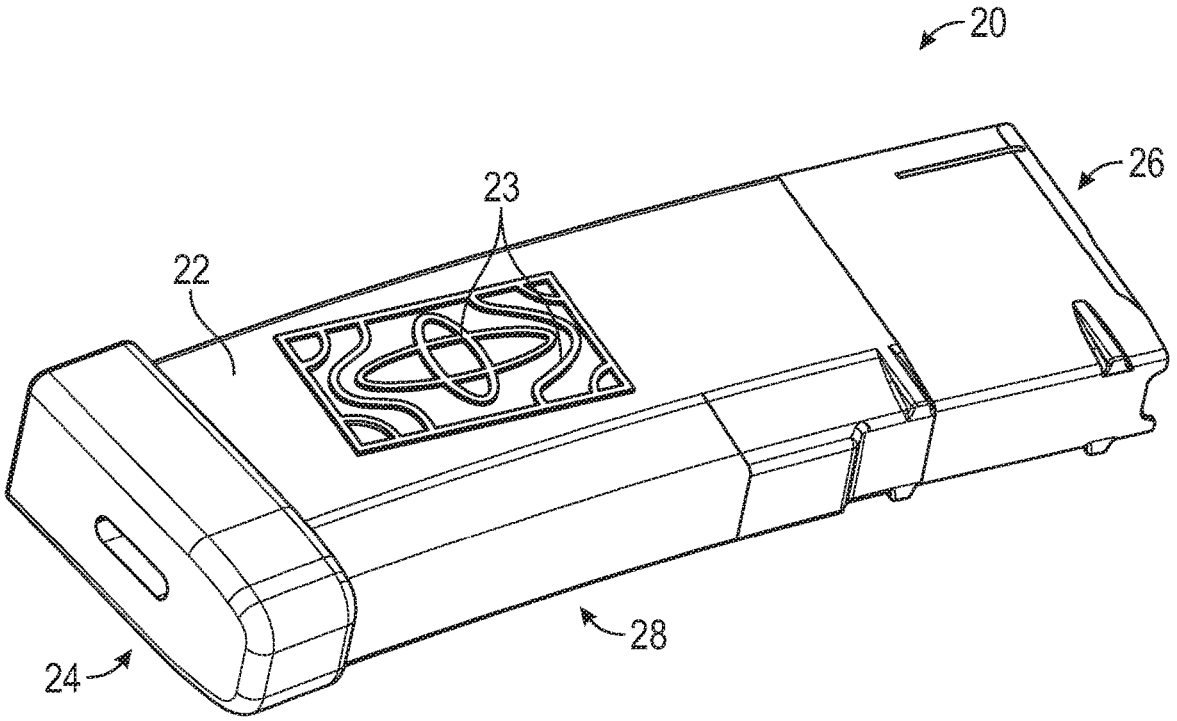
Figure 5:
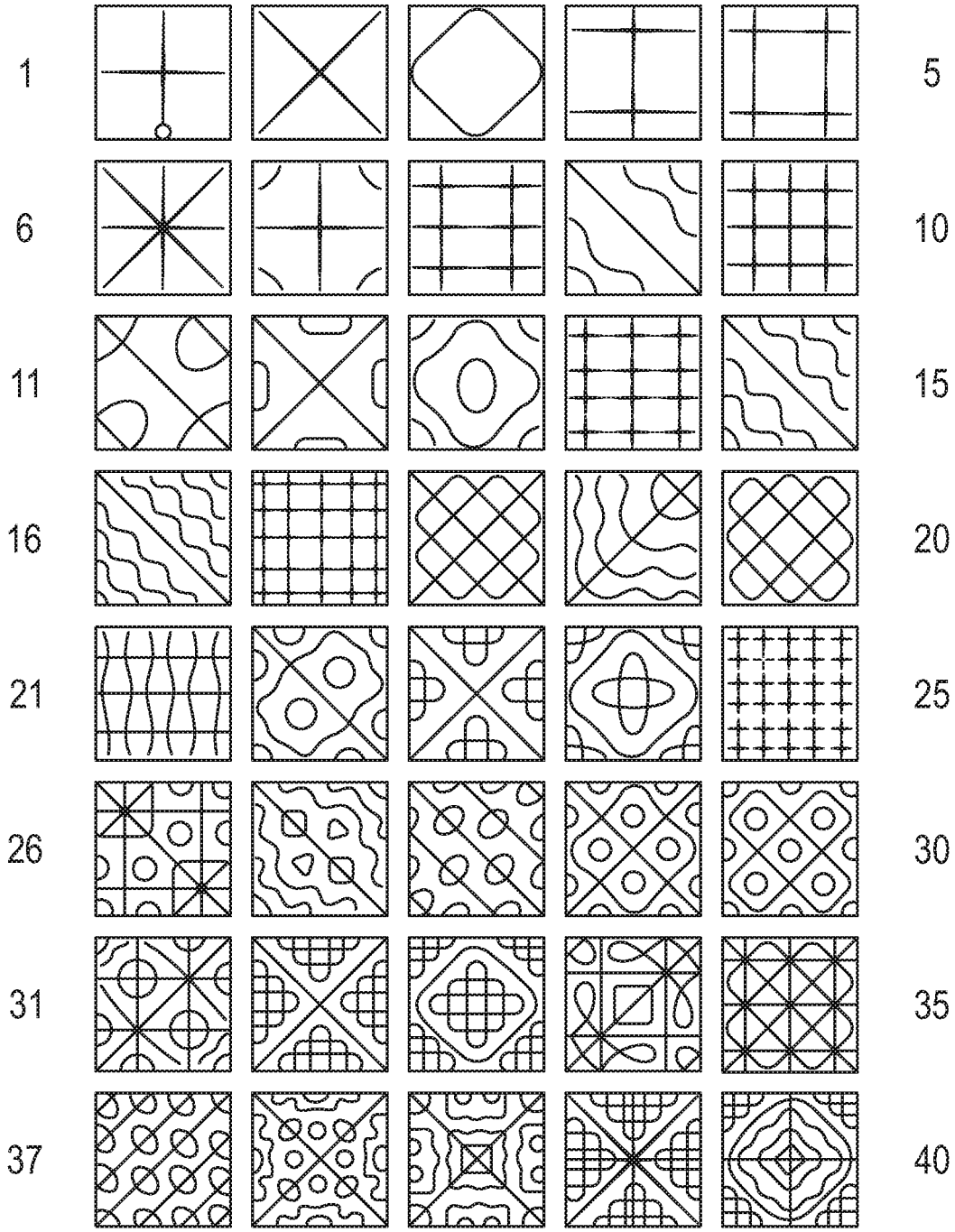
FIG. 5 illustrates predicted standing wave patterns for a rectangular membrane or plate excited by a haptic force.
Figure 7:
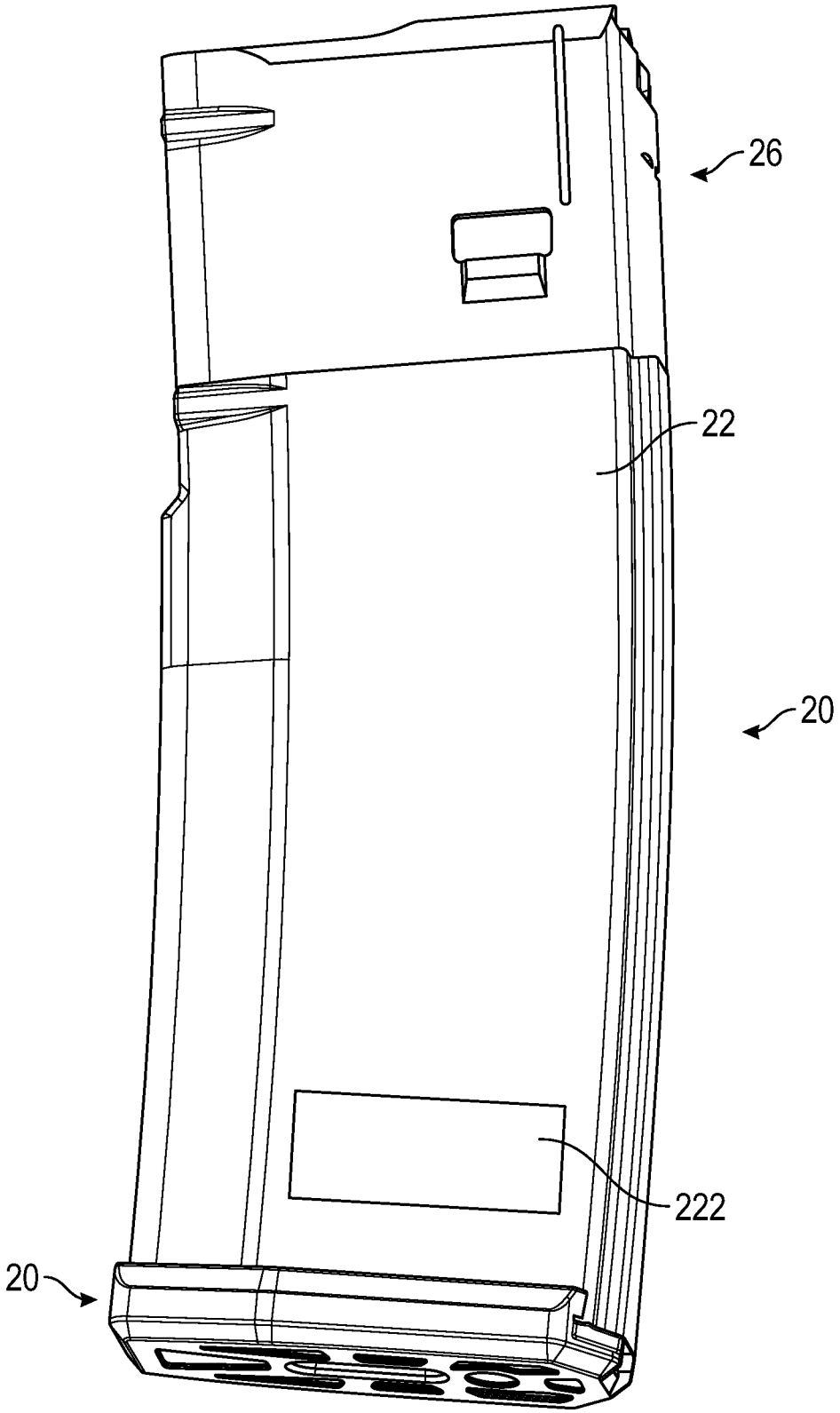
FIG. 7 illustrates an embodiment with a rectangular membrane 222 on the first portion 22.

As an example, FIG. 1 illustrates an embodiment of a magazine body 20 in which at least part of the magazine body 20 is configured or modified to have a natural vibration mode. More particularly, a magazine body side portion 28 may be bounded end and side portions and the magazine body side portion 28 has, or is configured to have, at least one first portion and one second portion that respectively correspond to the antinodes and nodes of a standing wave pattern of at least one natural vibration mode, and which at least one natural vibration mode is excited by selection or pairing with an appropriate haptic force. Moreover, alternate natural vibration modes of the magazine body 20 may be achieved by selecting, configuring, or modifying the first portion and second portion to respectively correspond to the antinodes and nodes of a standing wave pattern of another natural vibration mode, and again which natural vibration mode may be excited by selection or pairing with an appropriate haptic periodic force. FIG. 2 for another example, illustrates configuring or modifying the at least one first portion and one second portion to respectively correspond to the antinodes and nodes of a standing wave pattern of the second natural vibration mode and FIGS. 3 and 4 illustrate configurations of first and second portions to correspond to the twelfth and twenty-fourth natural vibration modes, respectively. FIG. 5 illustrates theoretical standing wave antinode and node patterns for corresponding Eigenvalue solutions, predicting resonant vibration modes (numbered here) 1-40. These predicted resonant frequency patterns correspond to a rectangular membrane 222 which may make up the entire structural body or a portion of the entire structural body. FIG. 7 illustrates an embodiment wherein a rectangular membrane 222 is included in or on a magazine body first portion 22 and that receives a haptic force. The standing wave patterns illustrate predicted antinodes (lighter areas) and nodes (darker areas) for each Eigenvalue solution and correspond to the intended resonant frequency response outputs of a magazine body 20 designed according to this description. The illustrated magazine bodies 20 may be configured or modified to augment or reinforce a natural vibration mode by exploitation of relative rigidities of the first and second portions. One such strategy includes construction of the first portion to be thicker, and hence more rigid and less flexible, than the second portion. Another strategy includes construction of the second portion from a different, stiffer, material than the first portion, and yet another strategy involves the creation of a second portion by the application of a stiffening structure to the first portion. Each strategy may be used separately or in combination to achieve the intended result.

A magazine body 20 exploiting one of the strategies above may further be described as having a base 24, a body first side portion 22, and a cartridge feed-end 26. Cartridges may be loaded into the feed-end 26 to contact depress a spring biased follower and the magazine body 20 may be coupled to the firearm with the feed-end 26 securable within the firearm. The base 24 may serve as a locking or base plate for the magazine body 20 and similar to the feed-end 26 may be constructed from a relatively rigid material as comparted to the body first side portion 22. The base 24 and feed-end 26 may each comprise relatively rigid, hollow frame structures with perimeters that form the perimeter of the hollow interior of the magazine body 20 and provide a relatively non-deformable structure against which the ends of the body first side portion 22 may be secured and that serve as a non-flexing boundary around the body first side portion 22. Accordingly, the body first side portion 22 may have a length that extends between, and is bounded on, opposite ends by the base 24 and the feed-end 26, and has a width that may be bounded and secured by comparatively rigid or non-flexing magazine body side portions 28. It should be readily apparent that one could omit one, or maybe two, of the base 24, the feed-end 26, or body side portions 28, or construct said elements from alternate materials and rigidities and remain within the intended scope of this disclosure.

It is preferred that the body first side portion 22 comprise a structure that is deformable or flexible relative to at least two of the base 24, the feed-end 26, and the magazine body side portions 28, which the relative deformability or flexibility may be achieved in any number of ways. For example, the shape of body first side portion 22 may be selected for its inherent relatively flexible characteristic as compared to the shapes of the base 24, the feed-end 26, or magazine body side portions 28. As a second example, the body first side portion 22, the base 24, the feed-end 26, or the magazine body side portions 28 may be constructed of the same material but the body first side portion 22 may be thinner than the body first side portion 22, the base 24, the feed-end 26, or the magazine body side portions 28. In the illustrated embodiments, the body first side portion 22 comprises a relatively thin rectangular plate which has at least one known or predicted natural vibration mode; and, a stiffening structure, such as at least one structural rib 23, is added to the body first side portion 22 at a predicted location of a node(s) of a standing wave pattern. As illustrated, the structural rib 23 may be constructed integrally to, or applied to the top surface of, the body first side portion 22.

The teachings herein may be extended to alternate implementations. Thus, the first and second portions may be implemented internally within the magazine body 20, externally (as illustrated) or integrated into the entire magazine body structure, and (as illustrated in FIG. 4), the body first side portion 22 with stiffening ribs 23 may be constructed as a externally applicable structure, such as a patch, that is adhered onto a magazine body 20. Finally, the teachings herein may be extended to magazine embodiments that have been designed or modified to exploit the known or predicted natural vibration modes corresponding to alternate standing wave patterns. Additionally, multiple patches, with different resonant frequency responses may be employed, where different haptic inputs excite the different patches to provide different indications e.g. one patch's excitation could indicate the operators low ammunition status, while the other patch's excitation could indicate a bug out command, or a low ammunition status for a comrade.

The haptic periodic force is applied by a haptic vibration motor 7 that is functionally coupled to a processor such as a microcontroller adapted or designed and programmed to interface with and control the haptic motor 7 and additional integrated circuitry. The microcontroller or functionally connected integrated circuitry may communicate wirelessly to a remote controller such as a second haptic magazine, a remote computer, or a user's phone to convey and/or receive information such as information regarding the status of the firearm, the user, or the magazine body 20. As an example, the microcontroller may operate under an executive control program to implement magazine status reporting and implements safety protocols such as locking and unlocking of the spring that advances ammunition rounds up the magazine body 20 and out of the feed-end 26.

Figure 6:
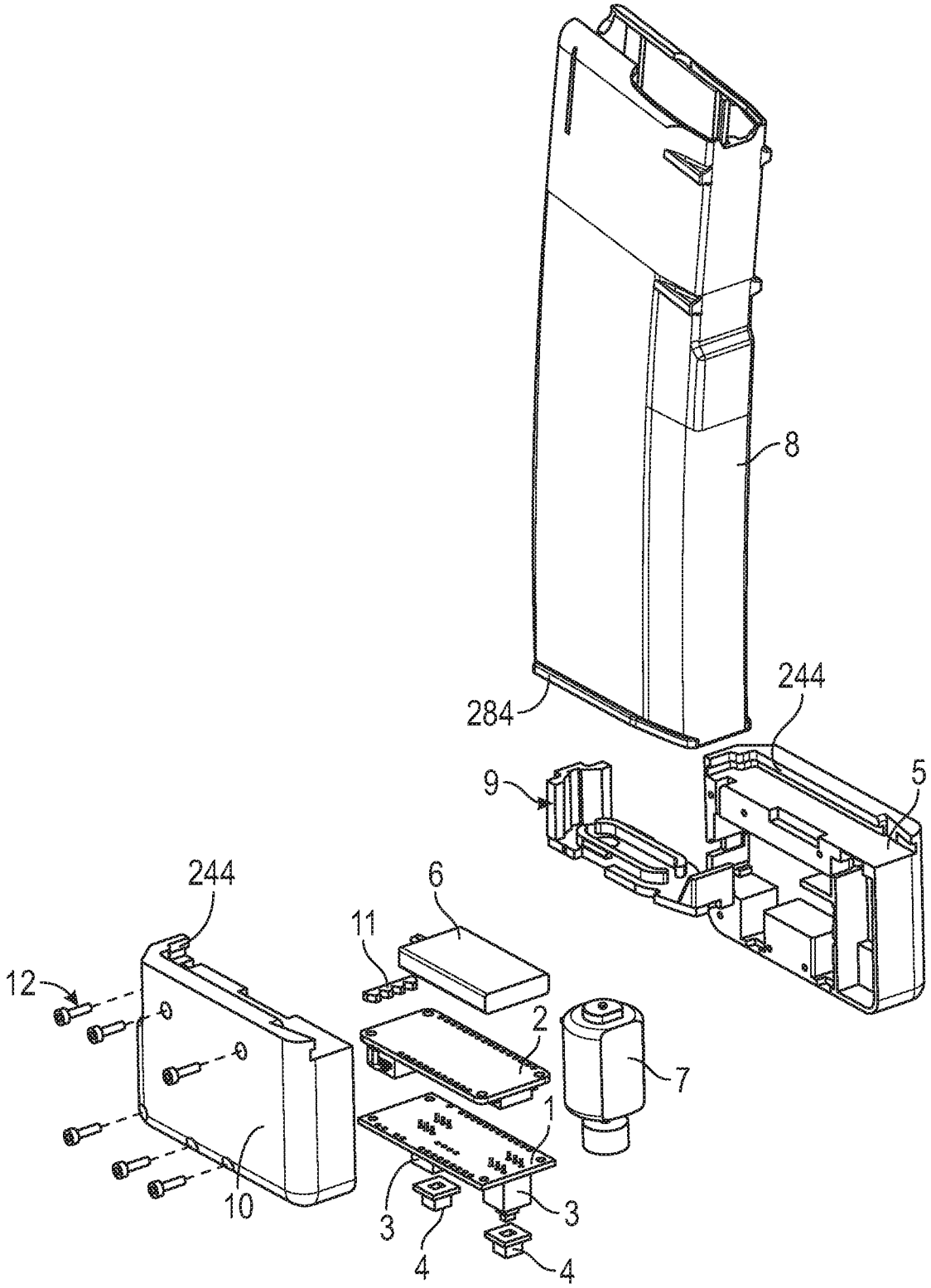
FIG. 6 illustrates an exploded view of a haptic motor subassembly that may be used with the disclosed embodiments.

FIG. 6 illustrates an exploded view of a preferred haptic motor subassembly wherein the haptic motor subassembly is positioned within the base 24. The illustrated embodiment features integrated and passive circuitry included on a first PCB 1 including a microcontroller and a second PCB 2 including a functionally coupled wireless communications IC implementing a Bluetooth® protocol. Power for the first and second PCB is supplied from a battery housed within the base 24 one or more buttons 4 are included for on/off switching or to set various operational modes of the microcontroller or the wireless communications IC.

The base 24 includes a base top edge that may be coupled to at least one of the magazine body side portions 28 to transfer vibrations from the haptic motor 7 to the entire magazine body 20. As an example, the base 24 may include a surface or channel 244 oriented substantially horizontally along the base top edge and substantially orthogonal relative to the length of the magazine body 20, and wherein the surface or channel 244 is dimensioned to receive a mated or matching surface or ridge 284 positioned on the magazine body side portion 28 and oriented substantially horizontally along the width (e.g. the bottom edge) of the magazine body side portion 28. Moreover, the base 24 may comprise two halves such that the ridge 284 may be positioned within the channel 244 and secured during final assembly of the magazine body 20.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

Any device utilizing a haptic response system could employ this same invention to become more efficient and extend battery life, without compromising its haptic-user interface. Examples include smart devices, phones, tablets, pagers, buck-shaker-stick (aircraft stall warning), shaker-steering-wheel (automotive drowsiness alert), and game interfaces to name a few.

The invention claimed is:

1. A firearm magazine, comprising:

a magazine body having a first portion and a second portion that correspond to the antinodes and nodes, respectively, of a standing wave pattern of at least one natural vibration mode of the magazine body, the second portion is more rigid than the first portion, and wherein a selected haptic force applied to the magazine body flexes the first portion more than the second portion and according to the at least one natural vibration mode.

2. The firearm magazine in claim 1 wherein, the second portion comprises a stiffening rib positioned on the first portion.

3. The firearm magazine in claim 1 wherein, the second portion is thicker than the first portion.

4. The firearm magazine in claim 3 wherein, the magazine body comprises an ammunition feed-end and a base at opposite ends of the magazine body and the first portion is positioned substantially between the ammunition feed-end and the base.

5. The firearm magazine in claim 4 wherein, the first portion is less rigid than at least one of the ammunition feed-end and the base and the haptic force moves the first portion more than at least one of the ammunition feed-end and the base.

6. The firearm magazine in claim 5 wherein, at least one of the base and feed-end comprises a relatively non-deformable structure against which the first portion may be secured.

7. The firearm magazine in claim 6 wherein, the haptic force is provided by a haptic motor positioned within the base.

8. The firearm magazine in claim 7 wherein, the base is coupled to at least one of the first portion or the second portion.

9. The firearm magazine in claim 8 wherein, the base is coupled to at least one of the first portion or the second portion by a channel dimensioned to receive a ridge.

10. The firearm magazine in claim 9 wherein, the base comprises two halves and the ridge is positioned within the channel and secured during connection of the two halves.

11. The firearm magazine in claim 1 further comprising, an alternate first portion and an alternate second portion, wherein the alternate second portion is more rigid than the alternate first portion and together correspond to an alternate standing wave pattern.

12. The firearm magazine in claim 11 further comprising, a haptic force having an alternate frequency is applied to the magazine body and moves the alternate first portion more than the alternate second portion and according to the alternate standing wave pattern.

13. The firearm magazine in claim 1 wherein, the magazine body has a plurality of resonant vibration modes and the standing wave pattern is selected from the resonant vibration modes.

14. The firearm magazine in claim 13 wherein, the resonant vibration modes correspond to a rectangular membrane.

15. A method of provided haptic notification, comprising:

providing a magazine body having a first portion and a second portion wherein the first portion and second portion correspond to antinodes and nodes, respectively of a standing wave pattern;

applying a haptic force to the magazine body; and flexing the first portion more than the second portion and according to the standing wave pattern.

16. The method in claim 15 wherein, the magazine body has a plurality of resonant vibration modes and the method further comprises flexing the first portion more than the second portion in a standing wave pattern selected from the resonant vibration modes.

17. A firearm magazine comprising:

a first portion and a second portion, the second portion is more rigid than the first portion, and a periodic force having a frequency is applied to the magazine and moves the first portion more than the second portion according to a predicted standing wave pattern for the magazine body; and an alternate first portion and an alternate second portion, wherein the alternate second portion is more rigid than the alternate first portion and together have an alternate natural frequency than the first portion and second portion; and a periodic force having an alternate frequency is applied to the magazine and moves the alternate first portion more than the alternate second portion according to a predicted standing wave pattern for the magazine body and alternate frequency.

* * * * *